US006845863B1

(12) United States Patent
Riley

(10) Patent No.: US 6,845,863 B1
(45) Date of Patent: Jan. 25, 2005

(54) CARD MAGNETIC STRIP PROTECTOR SLEEVE

(76) Inventor: Herman Riley, P.O. Box 116, Roosevelt, OK (US) 73564

( * ) Notice: Subject to any disclaimer, the term of this patent is extended or adjusted under 35 U.S.C. 154(b) by 52 days.

(21) Appl. No.: 10/421,016

(22) Filed: Apr. 22, 2003

(51) Int. Cl.[7] ..... A45C 11/18

(52) U.S. Cl. ..... 206/39; 206/39.5; 206/776; 283/904; 150/147

(58) Field of Search ..... 283/74, 75, 904; 150/147, 145; 235/449, 493, 462.01; 206/39, 39.5, 39.6, 555, 454, 775, 776, 524.3

(56) References Cited

U.S. PATENT DOCUMENTS 3,958,690 A * 5/1976 Gee, Sr. ..... 206/232
4,141,400 A * 2/1979 Mangan ..... 206/39.6
4,711,347 A * 12/1987 Drexler et al. ..... 206/38
5,005,106 A 4/1991 Kiku
5,288,942 A * 2/1994 Godfrey ..... 174/35 R
5,506,395 A * 4/1996 Eppley ..... 235/486
5,941,375 A * 8/1999 Kamens et al. ..... 206/38
6,121,544 A 9/2000 Petsinger
D431,719 S 10/2000 Mucarquer

FOREIGN PATENT DOCUMENTS

FR 2638619 A3 * 5/1990 ..... A45C/11/24

* cited by examiner

*Primary Examiner*—Bena Miller
(74) *Attorney, Agent, or Firm*—Randal D. Homburg

(57) ABSTRACT

A protective sleeve for the placement of credit cards or other cards bearing magnetic strips and bar codes on a rear surface of the cards is presented to place such card into the protective sleeve to prevent damage to the bar code and the magnetic strip attached to the cards, the sleeve having a front clear portion for the visual identification of the front of the card and a rear portion having a thin non-conductive metallic strip imbedded on the rear portion coinciding with the location of the magnetic strip on the card, and a smooth fabric portion coinciding with the location of the printed bar code on the card, the bar code and magnetic strip being generally provided on the rear surface of the card.

3 Claims, 2 Drawing Sheets

CARD MAGNETIC STRIP PROTECTOR SLEEVE

No cross-reference to related applications .

I. BACKGROUND OF THE INVENTION

1. Field of Invention

A protective sleeve for the placement of credit cards, driver license or other cards bearing magnetic strips and bar codes on a rear surface of the cards is presented to place such card into the protective sleeve to prevent damage to the bar code and the magnetic strip attached to the cards, the sleeve having a front clear portion for the visual identification of the front of the card and a rear portion having a thin non-conductive metallic strip imbedded on the rear portion coinciding with the location of the magnetic strip on the card, and a smooth fabric portion coinciding with the location of the printed bar code on the card, the bar code and magnetic strip being generally provided on the rear surface of the card 2. Description of Prior Art The following United States patents were discovered and are disclosed within this application for utility patent. All relate to card sleeves. In U.S. Pat. No. 5,288,942 to Godfrey, a cardholder is disclosed having a thin sheet of magnetically soft ferromagnetic material with high resistance to eddy currents, referenced as "keepers", to maintain at least one pattern of magnetism carried in at least one magnetic strip. In U.S. Pat. No. 5,941,375, a clear plastic or PVC sleeve is formed having pockets for the insertion of thin metal strips is provided to shield the magnetic portion of a card inserted within the sleeve, the metal strip defined as rolled aluminum or a nickel/iron alloy. Another sleeve protector intended to shield contactless smart cards or card containing RFID microchips is disclosed in U.S. Pat. No. 6,121,544 to Petsinger.

In addition, it is known through publication that a product is available on the market containing a fabric known as TYVEK®, which is marketed as an ATM Credit Card Protector Sleeve located at www.championbp.com. TYVEK® is manufactured by Dupont and the MSDS sheet on that product is disclosed herein, TYVEK® identified as a spunbonded olefin product. While these prior art reference discuss similar goals and similar concepts, the sleeve disclosed in the current invention is distinguished by elements which protect both the magnetic strip and the printed bar code ink material from damage during containment in the sleeve, which is not anticipated by the disclosed prior art either individually or in combination.

II. SUMMARY OF THE INVENTION

As indicated in prior art, the problem of damage to magnetic strips on credit card and the wear of ink on the printed portion of the card has long been a problem. Over time, the magnetic strips and ink comprising bar codes, numbers and signatures is know to wear or erode, rendering the card invalid or dysfunctional. As technology advances, these cards, used for identification, medical information and financing become more important to commerce, medical treatment, insurance information and identification. A solution to the protection of the several sensitive areas of the card requires more than the existing technology.

It is therefore the primary objective of the invention to provide a protective sleeve to prevent damage to the printed material on a credit card and shield the magnetic strip on the card from contact damage, friction and external magnetic or electric fields in a simple embodiment.

III. DESCRIPTION OF THE DRAWINGS

The following drawings arc submitted with this utility patent application.

IV. DESCRIPTION OF THE PREFERRED EMBODIMENT

Figure 3:
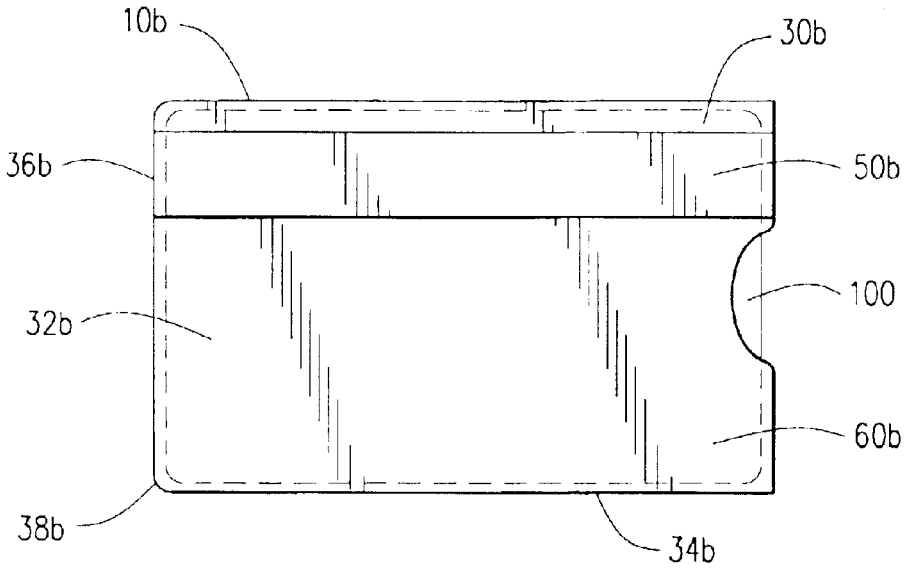
FIG. 3 is a rear view of a second embodiment of the sleeve.
Figure 4:
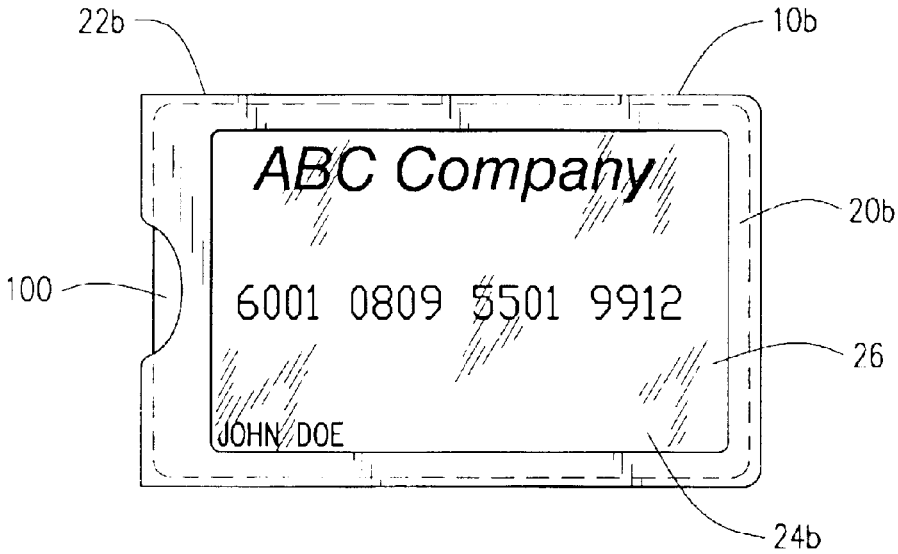
FIG. 4 is a front view of the second embodiment of the sleeve.
Figure 5:
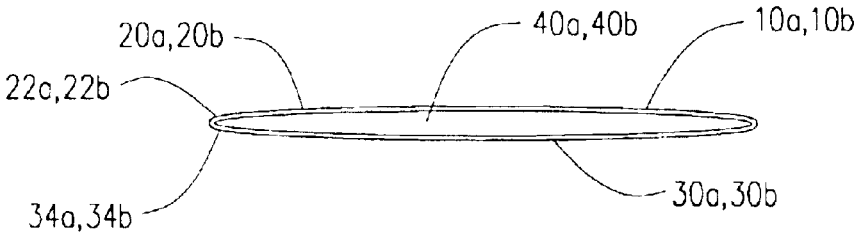
FIG. 5 is an end view of the sleeve.

A credit card magnetic strip protector sleeve, shown in FIGS. 1–5 of the drawings, for the protection of credit cards, driver licenses or other cards 100 containing printed bar codes 102 and magnetic strips 104 with encoded information comprises a flexible rectangular sleeve 10*a*, 10*b* having a front section 20*a*, 20*b* having a perimeter 22*a*, 22*b* and a rear section 30*a*, 30*b* having an outer surface 32*a*, 32*b* and a perimeter 34*a*, 34*b*, the front section perimeter 22*a*, 22*b* and rear section perimeter 34*a*, 34*b* joined along at least two sides, the front section 20*a*, 20*b* and rear section 30*a*, 30*b* defining a cavity 40*a*, 40*b*, FIG. 5, within which the card may be inserted, the rear section 30*a*, 30*b* further comprising an upper portion 36*a*, 36*b* incorporating a wafer thin section of non-conductive metal strip 50*a*, 50*b* overlying an area coinciding with the location of the magnetic strip 102 of the card 100, the rear section 30*a*, 30*b* further including a lower portion 38*a*, 38*b* incorporating a low friction fabric material 60*a*, 60*b* coinciding with the printed bar code 102 of the card 100, with the front section 20*a*, 20*b* having a transparent portion through which the card may be identified through the front section 20*a*, 20*b* of the sleeve 10*a*, 10*b*.

Figure 1:
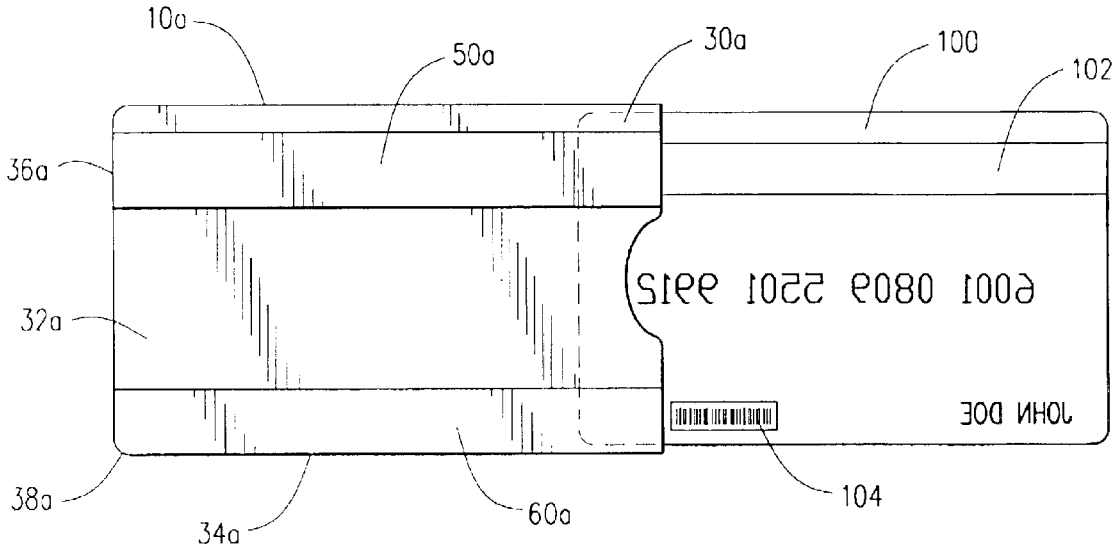
FIG. 1 is a rear view of a first embodiment of the sleeve.
Figure 2:
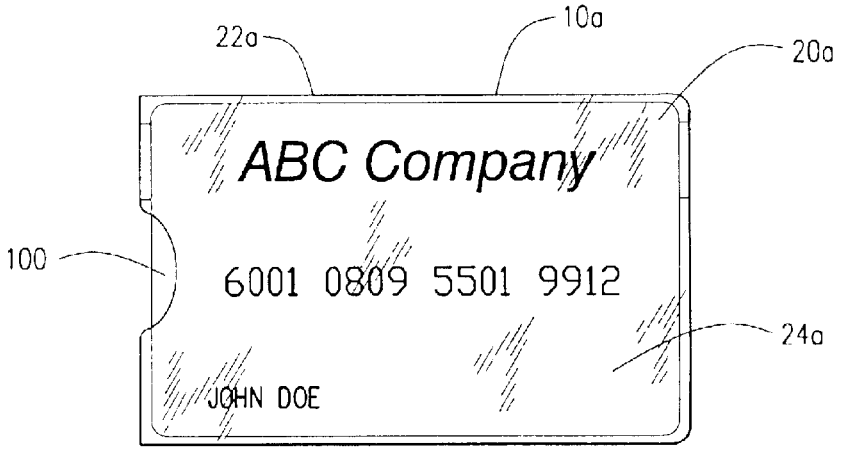
FIG. 2 is a front view of the first embodiment of the sleeve

In a first embodiment, shown in FIGS. 1–2 and 5, the sleeve 10*a* is made entirely of a transparent material, with the non-conductive metal strip 50*a* on the rear section 30*a* and the low friction fabric material 60*a* also on the rear section 30*a*. The front section 20*a*, made of a transparent material, allows for the visual identification of the card 100 contained within the sleeve 10*a* through the front section 20*a*.

In a second embodiment, FIGS. 3–5, the entire sleeve 10 is made of the low friction fabric material 60*b*, with the non-conductive metal strip 50*b* on the upper portion 36*b* of the rear section 30*b*, while the front section 20*b* includes a transparent window 26, FIG. 4, through which the front of the credit card can be seen while the card 100 is within the cavity 40*b*.

Most preferably, the non-conductive metal 50*a*, 50*b* is a thin sheet of copper, which is a preferred metal for very thin application where non-conductivity is desired. The non-conductive metal strip 50*a*, 50*b* is most preferably applied to the outer surface 32*a*, 32*b* of the rear section 30*a*, 30*b* of the sleeve 10*a*, 10*b* to prevent friction between the credit card 100 and the non-conductive metal strip 50*a*, 50*b*.

The preferred material for the low friction fabric 60*a*, 60*b* is a product identified by a trade name TYVEK®, a spunbonded olefin product, which is shown to exhibit low friction characteristics which maintains the integrity of printed and embossed ink on the surface of materials which are in contact with the TYVEK®.

What is claimed is:

1. A credit card magnetic strip protector sleeve for the protection of a credit cards or other card containing printed bar code and a magnetic strip with encoded information comprising:

a flexible rectangular sleeve having a front section having a perimeter and a rear section having an outer surface and a perimeter, said front section and rear section perimeters joined along at least two opposing sides, said front section and rear section defining a cavity within which said card may be inserted, said rear section further comprising an upper portion incorporating a wafer thin section of non-conductive metal strip overlying said magnetic strip of said card, said rear section further including a lower section incorporating a low friction fabric material overlying said printed bar code of said card, said front section further having a transparent portion through which said card may be visually identified through said front section of said sleeve.

2. The sleeve as disclosed in claim 1, wherein the entire sleeve is made of a transparent material, said non-conductive metal strip is copper, and said low friction fabric material is a spunbonded olefin product.

3. The sleeve, as disclosed in claim 1 wherein the entire sleeve is made of a spunbonded olefin product, said non-conductive metal strip is copper and attached to said upper portion of said outer surface of said rear section, and said front section includes a transparent window through which said credit card may be visually identified while contained within said cavity.

* * * * *